US006955123B1

(12) United States Patent
Kurtzer

(10) Patent No.: US 6,955,123 B1
(45) Date of Patent: Oct. 18, 2005

(54) PRINTING MACHINE WITH EQUILIBRIUM OR EQUALIZATION OF MOMENTS OR TORQUES

(75) Inventor: Siegfried Kurtzer, Mannheim (DE)

(73) Assignee: Heidelberger Druckmaschinen AG, Heidelberg (DE)

( * ) Notice: Subject to any disclaimer, the term of this patent is extended or adjusted under 35 U.S.C. 154(b) by 625 days.

(21) Appl. No.: 09/656,333

(22) Filed: Sep. 6, 2000

(30) Foreign Application Priority Data

Sep. 6, 1999 (DE) ..... 199 42 391

(51) Int. Cl.[7] ..... B41F 1/30
(52) U.S. Cl. ..... 101/409; 101/246
(58) Field of Search ..... 101/246, 409, 101/216, 248, 408, 410

(56) References Cited

U.S. PATENT DOCUMENTS 3,937,142 A * 2/1976 Cerny et al. ..... 101/409
4,132,403 A * 1/1979 Weisbach et al. ..... 271/277
5,271,323 A * 12/1993 Munker ..... 101/409
5,839,366 A * 11/1998 Schaede ..... 101/232
5,862,757 A * 1/1999 Hauck ..... 101/484
6,241,241 B1 * 6/2001 Fricke et al. ..... 271/245

FOREIGN PATENT DOCUMENTS

DE 2022245 11/1970
DE 4109824 A1 10/1991
DE 19532856 A1 3/1997

* cited by examiner

*Primary Examiner*—Ren Yan
(74) *Attorney, Agent, or Firm*—Laurence A. Greenberg; Werner H. Stemer; Ralph E. Locher

(57) ABSTRACT

A printing machine having at least one roller and at least a first and a second functional element for executing cyclic movements synchronized with a rotational movement of the roller and driven, together with the roller, by a drive unit, includes spring elements, respectively, assigned to the functional elements, the spring elements being stressed in one phase of the cyclic movement and relieved of stress in another phase of the cyclic movement, respectively, a phase wherein a first one of the spring elements is stressed being synchronized with a phase wherein a second one of the spring elements is relieved of stress.

7 Claims, 2 Drawing Sheets

PRINTING MACHINE WITH EQUILIBRIUM OR EQUALIZATION OF MOMENTS OR TORQUES

BACKGROUND OF THE INVENTION

Field of the Invention

The invention relates to a printing machine with equilibrium or equalization of moments or torques and, more particularly, to a printing machine having at least one roller for transporting material to be printed and at least a first and a second functional element which execute a cyclic movement that is synchronized with a rotational movement of the roller and which are driven, together with the roller, by a drive unit, the functional elements, respectively, having assigned thereto a spring element that is stressed in one phase of the cyclic movement and is relieved of stress in another phase thereof. Functional elements of this type are generally widespread in printing machines, for example, in the form of sheet grippers which are mounted on the rollers and which, respectively, have to be open in a defined position of the roller in order to accept a material sheet to be printed, have to be in a closed state so as to draw the sheet along a transport path thereof through the printing machine and, in a second orientation of the roller, have to be opened so that the sheet can leave the roller and can be transferred to a different roller or a delivery.

While the torque necessary for driving the rotational movement of the rollers is constant over time, the torque to be applied by the drive unit for driving the cyclic movement of the functional elements oscillates with a period which corresponds to the operating cycle of the printing machine. These torque fluctuations lead to disturbances in the synchronized running or rotation of the rollers, which can result in register errors and, thereby, spoilage or rejects. Although the problem of disturbances or disruptions in the synchronous running of the rollers can in theory be eliminated by providing separate drives for the rollers and the functional elements, such a solution founders or is wrecked on the high mechanical complexity and the costs associated therewith, in particular when the functional elements are mounted on the rollers and rotate together therewith, as is the case in particular with sheet grippers.

The published German Patent Document DE 41 09 824 A1 discloses power or output differential gearing for a pregripper that has a cyclically varying moment of inertia. If a drive torque is required for the pregripper over the course of the operating cycle of the gearing, the moment of inertia is reduced. Such torque compensation is sluggish and mechanically complicated, because of the mass of the flywheel masses which have to be displaced radially.

SUMMARY OF THE INVENTION

It is accordingly an object of the invention, therefore, to provide a printing machine of the type described at the introduction hereto wherein torque fluctuations are reduced due to the drive torque requirement of the functional elements, which varies over the course of the operating cycle of the machine, and is also capable of compensating for rapid fluctuations.

With the foregoing and other objects in view, there is provided, in accordance with the invention, a printing machine having at least one roller and at least a first and a second functional element for executing cyclic movements synchronized with a rotational movement of the roller and driven, together with the roller, by a drive unit, comprising spring elements, respectively, assigned to the functional elements, the spring elements being stressed in one phase of the cyclic movement and relieved of stress in another phase of the cyclic movement, respectively, a phase wherein a first one of the spring elements is stressed being synchronized with a phase wherein a second one of the spring elements is relieved of stress.

In accordance with another feature of the invention, the printing machine includes a cam disk for aiding in coupling the cyclic movement of each of the functional elements to the rotational movement of the roller.

In accordance with a further feature of the invention, at least one of the functional elements is a sheet gripper mounted on the roller.

In accordance with an added feature of the invention, the printing machine includes another roller, at least one of the functional elements being a sheet gripper mounted on the other roller.

In accordance with an additional feature of the invention, a first one of the functional elements is a sheet gripper mounted on a feed cylinder, and a second one of the functional elements is a sheet gripper mounted on an impression cylinder.

In accordance with yet another feature of the invention, a position for accepting a sheet to be printed from the feed cylinder and a position for surrendering the printed sheet are defined on the impression cylinder and, on a path from the surrender position to the acceptance position, the sheet gripper of the impression cylinder is actuatable for executing one of a movement stressing the spring element assigned thereto and a movement relieving the stress, while the sheet gripper of the feed cylinder is actuatable for executing one of a closing movement relieving the stress on the spring element assigned thereto and a closing movement stressing the spring element.

In accordance with yet a further feature of the invention, the impression cylinder has a circumference that is a given number of times the circumference of the feed cylinder and includes a number of the sheet grippers rotating with the impression cylinder, that is equal to the given number.

In accordance with yet an added feature of the invention, the surrender position is defined so that the length of the path of the sheet gripper from the surrender position to the acceptance position is from at least half to all of the circumferential length of the feed cylinder.

In accordance with yet an additional feature of the invention, the movement of the sheet gripper of the impression cylinder is a closing movement for passing through a bottleneck.

In accordance with a concomitant feature of the invention, the printing machine includes another first functional element formed as a pregripper.

Thus, in accordance with the invention, respectively, a phase wherein a first spring element is stressed is synchronized with a phase wherein a second spring element is relieved of stress. In this way, the drive torque which is released when the second spring element being is relieved of stress is used directly for stressing the first spring element, and an acceleration of the roller otherwise associated with the relief of stress, and a braking due to the stressing of the first spring element, respectively, are dispensed with. A displacement of flywheel masses is unnecessary therefor, and abrupt changes in the drive torque can therefore also be compensated for.

The cyclic movement of each functional element is preferably coupled to the rotational movement of the roller with the aid of a cam disk.

The mutually compensating functional elements may advantageously be sheet grippers which are mounted on two different rollers in the printing machine, for example, an impression cylinder and a feed cylinder.

Between a position wherein the sheet gripper of the impression cylinder surrenders or discharges a printed sheet and a position wherein that sheet gripper accepts a sheet to be printed, the sheet gripper of the impression cylinder necessarily covers a given path whereon it does not hold a sheet and whereon it is consequently of no importance for the functioning of the printing machine whether the sheet gripper is open or closed. It is therefore expedient to construct the machine so that the sheet gripper of the impression cylinder is on the path thereof from the surrender or discharge position to the acceptance position when the sheet gripper of the feed cylinder has to execute a closing movement in order to grip a sheet. The stressing or relieving of the spring element belonging to the sheet gripper of the feed cylinder and associated with the closing movement thereof can therefore be compensated for in a simple way by the sheet gripper of the impression cylinder, on the path from the surrender or discharge position to the acceptance position, while, at the same time, the sheet gripper of the impression cylinder executes a movement which relieves or stresses the spring element associated therewith.

The impression cylinder preferably has a circumference that is a given number, say n, times the circumference of the feed cylinder and includes that given number, i.e., n, sheet grippers rotating with the impression cylinder. This feature facilitates the synchronization of the movement of one of the sheet grippers of the impression cylinder with the movement of the sheet gripper of the feed cylinder, respectively.

In particular, in the case of such an impression cylinder, it is possible to select a length of the path of the sheet gripper from the surrender or discharge position to the acceptance position that is at least half as long and preferably even at least exactly as long as the circumferential length of the feed cylinder. This also facilitates the synchronization of the mutually compensating movements of the sheet grippers.

The compensating movement of the sheet gripper of the impression cylinder may expediently be a closing movement which is necessary for enabling the sheet gripper to pass through a bottleneck. Such a bottleneck can be formed, for example, by a washing device that is disposed between the surrender or discharge position and the acceptance position for the purpose of cleaning the impression cylinder.

A further functional element, which executes a cyclic movement with stressing of a spring element and relieving of the stress, and has a torque profile that can be compensated for by another functional element, can be a pregripper, for example.

Other features which are considered as characteristic for the invention are set forth in the appended claims.

Although the invention is illustrated and described herein as embodied in a printing machine with equilibrium or equalization of moments or torques, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings, wherein:

DESCRIPTION OF THE PREFERRED EMBODIMENTS

Figure 1:
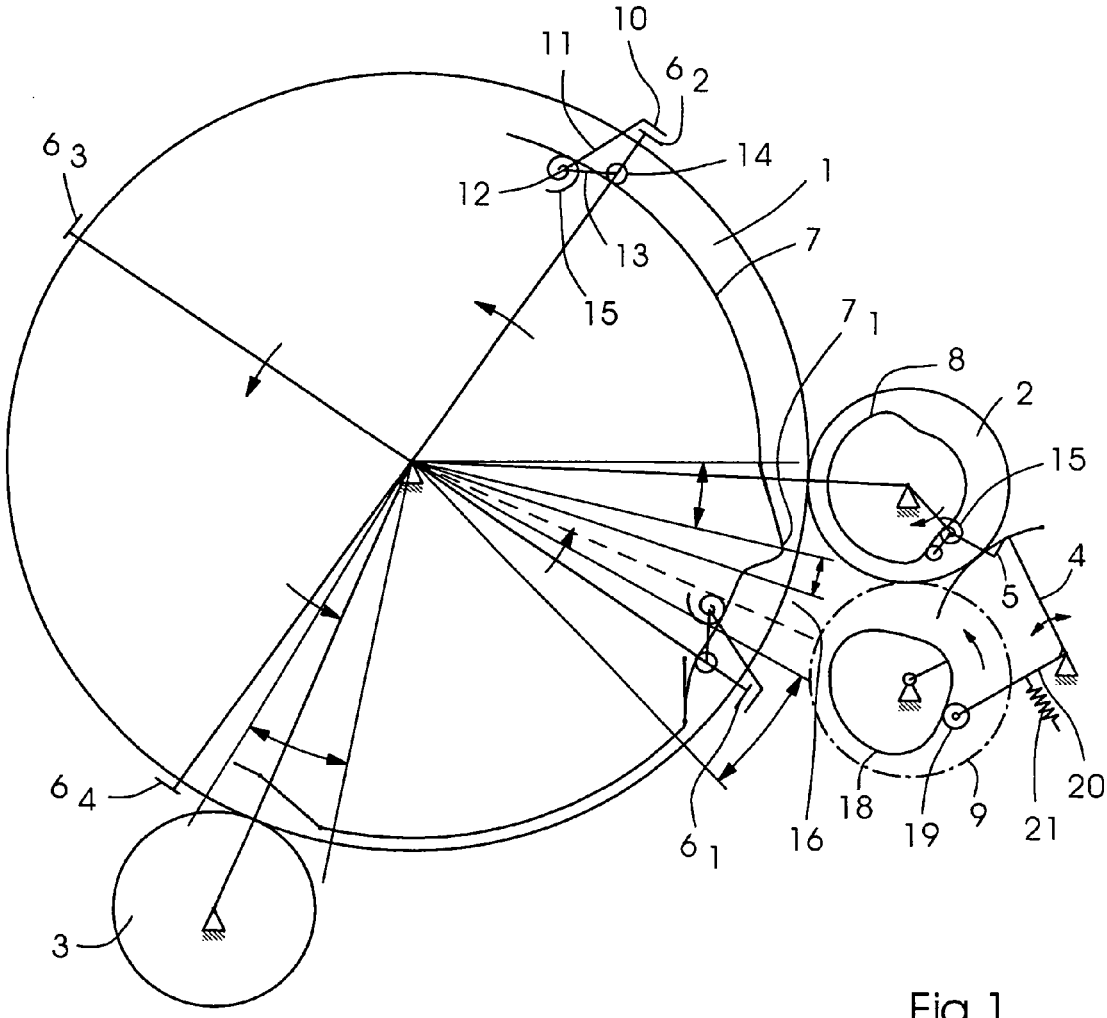
FIG. 1 is a fragmentary highly diagrammatic and schematic side elevational view of a printing unit of a printing machine constructed in accordance with the invention of the instant application.

Referring now to the drawings and, first, particularly to FIG. 1 thereof, there is shown therein an impression cylinder 1 and, in contact with the circumferential surface thereof, a feed cylinder 2 and a delivery cylinder 3. The feed cylinder 2 has a sheet gripper 5, and the impression cylinder, which has a circumference four times that of the feed cylinder 2, has four sheet grippers $\mathbf{6}_1$, $\mathbf{6}_2$, $\mathbf{6}_3$ and $\mathbf{6}_4$, respectively, which are arranged at an interval of 90° from one another.

The construction of the sheet grippers 5, $\mathbf{6}_1$, $\mathbf{6}_2$, $\mathbf{6}_3$ and $\mathbf{6}_4$ is largely identical. Taking for example the sheet gripper $\mathbf{6}_2$, as illustrated, each of the sheet grippers includes a clip or yoke 10 that extends over the width of the roller in order to clamp one edge of a sheet firmly onto the outer surface of the roller, and which is suspended articulatedly at a location 12 on the roller by lateral arms 11. A second arm 13 is rigidly connected to the arm 11 and, at the end thereof, bears a roller 14 which rolls on a cam disk 7 of the impression cylinder 1 or, respectively, on a cam disk 8 of the feed cylinder 2. The cam disks 7 and 8, respectively, are fixed in position, while the cylinders 1 and 2, respectively, rotate in relation thereto. A helical or spiral return spring 15 holds the roller 14 pressed against the surface of the cam disk 7 and 8, respectively.

In the case of the sheet grippers $\mathbf{6}_1$ to $\mathbf{6}_4$ of the impression cylinder 1, the closed position wherein the sheet gripper $\mathbf{6}_2$ is illustrated corresponds to the state wherein the helical return spring 15 is relieved of stress. If the roller 14 rolls on an area of the cam disk 7 having a greater radius than that at the location of the gripper $\mathbf{6}_2$, the clip 10 is spread away from the surface of the impression cylinder 1, and the spring 15 is stressed. In the case of the sheet gripper 5 of the feed cylinder 2, the behavior is quite the opposite. When the roller runs on an area with a large radius of the cam disk 8 and the helical spring is stressed, the clip is closed; the position wherein the spring is relieved of stress corresponds to the open position of the clip.

With a transmission ratio of 1:1, a gearwheel 9 is meshed with a gearwheel that is not specifically shown but belongs to the feed cylinder 2, and drives a third cam disk 18 to perform a rotational movement. With the aid of a cantilever arm 20 that is rigidly connected to the pregripper 4, a roller 19 that rolls on the cam disk 18 converts the rotation of the cam disk 18 into an oscillating movement of the pregripper 4. A compression spring 21 holds the roller 19 pressed against the cam disk 18.

The operating cycle of the printing machine is explained hereinafter with reference to FIG. 2, as well.

FIG. 1 shows the pregripper 4 in a position wherein it transfers a non-illustrated sheet to be printed to the sheet gripper 5 of the feed cylinder 2. While the feed cylinder 2 continues to rotate in clockwise direction from the position thereof shown in FIG. 1, the pregripper 4 follows it until the sheet gripper 5 has clamped the sheet on the circumferential surface of the feed cylinder 2 and holds it firmly. When this has been done, the pregripper 4 releases the sheet and swings in the opposite direction in order to fetch a further sheet from a feed pile.

Figure 2:
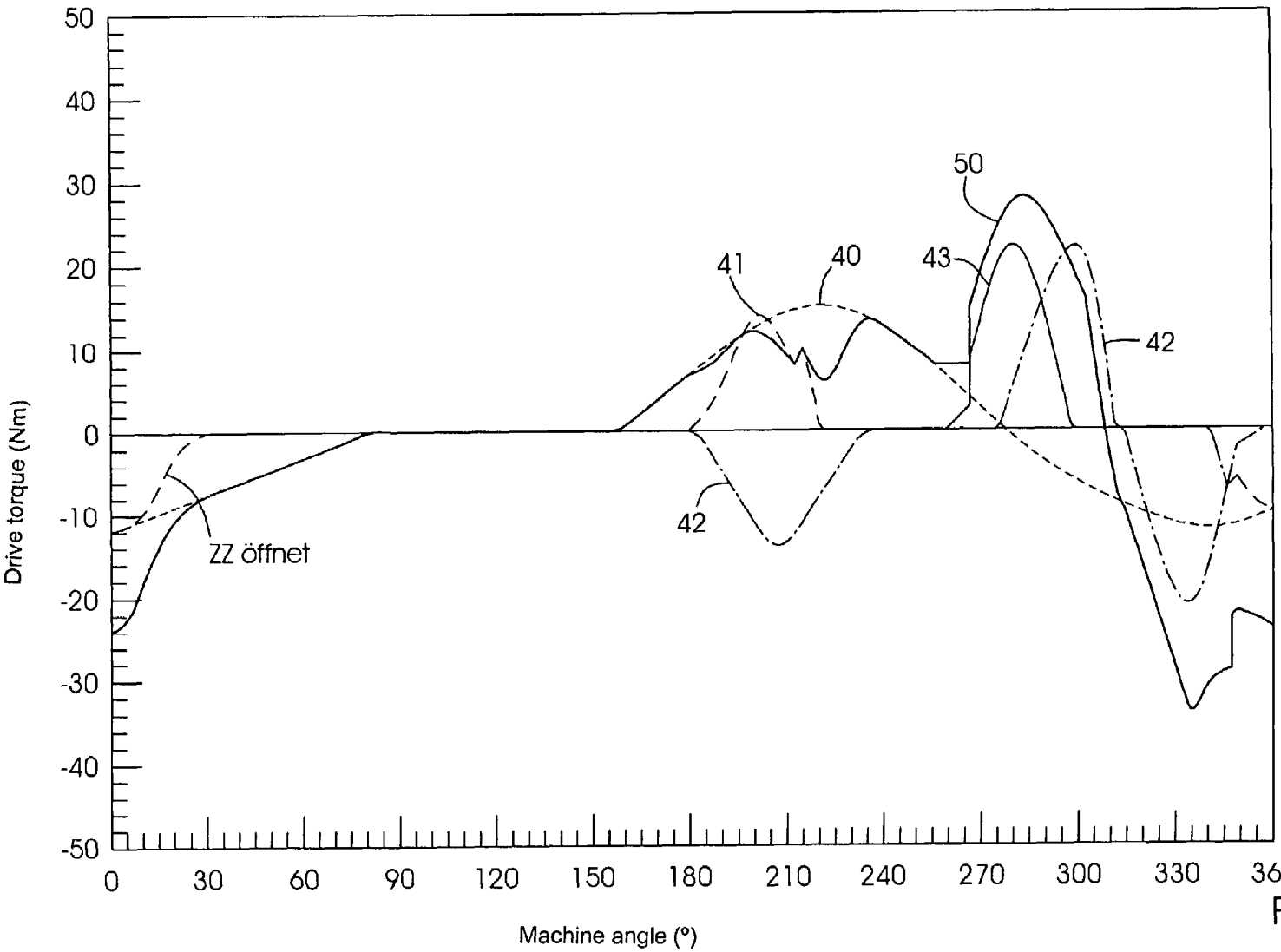
FIG. 2 is a plot diagram showing the profile of a torque to be applied by a drive unit of the printing machine as a function of the rotational angle.

FIG. 2 shows the course or profile of the drive torques of the various functional elements of the printing machine of FIG. 1 as a function of or in accordance with a machine rotational angle, which is referred here to the rotation of the feed cylinder 2. The configuration shown in FIG. 1 corresponds approximately to a machine angle of 190° in FIG. 2.

The drive torque of the pregripper is illustrated as a Somewhat dotted-line curve 40. The drive torque is positive in an angular range from about 160 to about 290°, which corresponds to a movement of the pregripper 4 in the direction of the feed cylinder 2 with simultaneous compression of the spring 21. In the angular range from about 290 to about 70°, the pregripper 4 returns to the feed stack, the compression spring 21 being relieved of stress and exerting a driving torque on the entire arrangement.

The torque profile of the sheet gripper 5 is illustrated as a curve 41 formed by dashes. Positive values of this curve in the range from 180 to 220° correspond to the closing movement of the pregripper with the simultaneous application of stress to the spring thereof.

In FIG. 1, the sheet gripper $\mathbf{6}_1$ is illustrated in a closed position thereof. This position is necessary in order that the sheet gripper $\mathbf{6}_1$ can pass through a bottleneck 16, wherein a non-illustrated washing device for cleaning the impression cylinder is arranged. After passing through the bottleneck 16, the sheet gripper $\mathbf{6}_1$ opens, driven by a forward projection $\mathbf{7}_1$ on the cam disk 7. The curve 42 formed as a dot-dash line shows the profile of the drive torque for the sheet gripper $\mathbf{6}_1$ in FIG. 2. The closing movement prior to the passage through the non-illustrated washing device extends over an angular range from about 180 to 240°. Because this closing movement takes place with a simultaneous relief of the stress on the associated spring, it acts like an additional drive. The action of opening the gripper $\mathbf{6}_1$ on the rising edge of the projection $\mathbf{7}_1$ takes place at angles from about 275 to 310°, and the immediately following renewed closing as the sheet is accepted by the gripper 5 extends over an angle from about 310 to 0°.

Approximately while the sheet gripper $\mathbf{6}_1$ is traversing the bottleneck 16, the sheet gripper $\mathbf{6}_4$ is passing a surrender position for surrendering a printed sheet to the delivery cylinder 3. In this position, the sheet gripper $\mathbf{6}_4$ has to open in order to release the sheet. This is performed with a simultaneous application of stress to the spring, and the corresponding drive torque is illustrated as a curve 43 formed as a continuous solid line which has positive values approximately between 265 and 300°.

A curve 50 formed as a thick solid line shows the fluctuations of the drive torque over the course of one revolution of the feed cylinder 2. It is believed to be apparent that the section of the curve 41 of the sheet gripper 5, wherein the curve has positive values, completely overlaps a negative-value section of the curve 42 of the sheet gripper $\mathbf{6}_1$. In this way, the additional drive torque needed to close the sheet gripper 5 is made available completely by the spring of the sheet gripper $\mathbf{6}_1$, and, in addition, this spring even further compensates to some extent for the drive torque needed for the movement of the pregripper 4. The negative section of the curve 42 may conveniently be synchronized with the closing phase of the sheet gripper 5, in the case of the construction shown in FIG. 1, because, for the functioning of the printing machine it is simply a case of the gripper $\mathbf{6}_1$ being closed before it passes through the bottleneck 16, but it is completely unimportant, however, at which point on the path of the gripper from the discharge position on the delivery cylinder 3 to the bottleneck this closing movement takes place. If the distance between these two points is greater than one circumferential length of the feed cylinder 2, synchronization is always possible.

Of course, the principle described herein specifically for the case of drive torque compensation between sheet grippers of the impression cylinder and of the feed cylinder or the pregripper can also be applied to other situations wherein movements of functional elements, to be executed cyclically, lead to an oscillation of the necessary drive torque. It would therefore also be conceivable, for example, to synchronize the individual sheet grippers of the impression cylinder 1 of FIG. 1 with one another in such a way that the closing of one gripper during the acceptance of a sheet to be printed by the feed cylinder 2 coincides with the opening of another sheet gripper during the surrender or discharge of a printed sheet onto the delivery cylinder 3.

I claim:

1. A printing machine, comprising:

a drive unit;

rollers having a rotational movement and including a first sheet transport cylinder and a second sheet transport cylinder;

a first sheet gripper mounted on said first sheet transport cylinder;

a second sheet gripper mounted on said second sheet transport cylinder;

said first and second grippers executing cyclical movements having phases and being synchronized with said rotational movement of said rollers and driven, together with said rollers, by said drive unit;

said first and second grippers having respective spring elements, said spring elements being stressed in one of said phases of the cyclic movement and relieved of stress in another of said phases of the cyclic movement, a respective one of said phases having a first one of said spring elements stressed being synchronized with a respective one of said phases having a second one of said spring elements relieved of stress;

said second sheet transport cylinder having a position defined for accepting a sheet to be printed from the first sheet transport cylinder and a position defined for surrendering the printed sheet and, on a path from said surrender position to said acceptance position, said second sheet gripper being actuatable for executing one of a movement stressing said spring element assigned thereto and a movement relieving the stress, while said first sheet gripper being actuatable for executing one of a closing movement relieving the stress on said spring element assigned thereto and a closing movement stressing said spring element.

2. The printing machine according to claim 1, including a cam disk for aiding in coupling the cyclic movement of each of the first and second grippers to the rotational movement of the rollers.

3. The printing machine according to claim 1, wherein said surrender position is defined so that the length of said path of said sheet gripper from said surrender position to said acceptance position is from at least half to all of the circumferential length of said feed cylinder.

4. The printing machine according to claim 1, including another first functional element formed as a pregripper.

5. The printing machine according to claim 1, wherein said first sheet transport cylinder is a feed cylinder and said second sheet transport cylinder is an impression cylinder.

6. The printing machine according to claim 5, wherein said impression cylinder has a circumference that is a given number of times the circumference of said feed cylinder and includes a number equal to said given number of said second sheet grippers rotating with said impression cylinder.

7. The printing machine according to claim 5, wherein the movement of said second sheet gripper of said impression cylinder is a closing movement for passing through a bottleneck.

* * * * *